US005661914A

United States Patent [19]

Millet

[11] Patent Number: 5,661,914

[45] Date of Patent: Sep. 2, 1997

[54] ACCESS LAUNDRY APPLIANCE

[75] Inventor: J. Christopher Millet, Newton, Iowa

[73] Assignee: Maytag Corporation, Newton, Iowa

[21] Appl. No.: 661,146

[22] Filed: Jun. 10, 1996

Related U.S. Application Data

[63] Continuation of Ser. No. 324,334, Oct. 17, 1994, abandoned.

[51] Int. Cl.[6] ..... F26B 11/02

[52] U.S. Cl. ..... 34/601; 34/603; 34/609

[58] Field of Search ..... 34/595, 601–604, 34/609, 596; 432/103, 104, 117

[56] References Cited

U.S. PATENT DOCUMENTS

| | | | |
|---|---|---|---|
| 2,547,238 | 4/1951 | Tremblay | 34/603 |
| 2,628,432 | 2/1953 | Morrison . | |
| 2,722,119 | 11/1955 | Constantine . | |
| 2,734,368 | 2/1956 | Richardson . | |
| 2,748,496 | 6/1956 | Hellyer | 34/603 |
| 2,784,500 | 3/1957 | Beaumont | 34/602 |
| 2,813,415 | 11/1957 | Clark . | |
| 3,155,462 | 11/1964 | Erickson et al. | 34/82 |
| 3,531,954 | 10/1970 | Krupsky | 68/18 |
| 3,555,701 | 1/1971 | Hubbard | 34/602 |
| 4,007,546 | 2/1977 | Sauer | 34/602 |
| 4,516,335 | 5/1985 | Aoki et al. | 34/133 |
| 4,854,054 | 8/1989 | Johnson | 34/133 |
| 5,333,393 | 8/1994 | Hill et al. | 34/600 |

FOREIGN PATENT DOCUMENTS 2 164 666 3/1986 United Kingdom .

*Primary Examiner*—Henry A. Bennett
*Assistant Examiner*—Susanne C. Tinker
*Attorney, Agent, or Firm*—Zarley, McKee, Thomte, Voorhees & Sease

[57] ABSTRACT

An improved access laundry appliance is provided for a cabinet defining an enclosed compartment. A cylindrical drum is rotatably mounted within the compartment and forms a fabric enclosure for containing laundry therein. The drum has an uncovered drum access opening through which laundry may be placed into and removed from the fabric enclosure. The cabinet has exterior front and top cabinet surfaces formed by cabinet front and top walls and includes a cabinet access opening therein adjacent the drum access opening providing direct communication through the cabinet and the drum access opening into the fabric enclosure. The cabinet access opening is formed at least partially in the cabinet front wall and at least partially in the cabinet top wall and has a perimeter extending therearound. The perimeter extends between first and second substantially vertical planes which are spaced apart from one another. A cabinet door is moveable from an open position providing unhindered access into the fabric enclosure to a closed position in covering relation over the cabinet access opening.

8 Claims, 3 Drawing Sheets

ACCESS LAUNDRY APPLIANCE

This is a continuation of application Ser. No. 08/324,334 filed on Oct. 17, 1994 now abandoned.

BACKGROUND OF THE INVENTION

This invention relates to an improved access laundry appliance.

Typical front loading laundry appliances provide access to an inner rotating drum or tumbler from the front of the cabinet in order to permit the insertion and removal of fabrics for washing or drying. This access has, in the past, been provided by an opening in the front wall of the appliance cabinet. The size and position of the opening available in the cabinet front wall has hindered the insertion and removal of items into the fabric container or drum. Also, vision into the drum is hindered because the operator must bend over in order to see into the drum. In these prior appliances, the operator's reach into the drum was also limited.

Therefore a primary object of the present invention is the provision of an improved access laundry appliance.

A further object of the present invention is to provide improved visibility into the drum.

A further object of the present invention is the provision of a laundry appliance in which accessibility to the drum is provided through an opening shared by the top and front wall of the cabinet enclosure.

A further object of the present invention is the provision of an improved access laundry appliance which provides more flexibility in the location of the outlet air duct and lint filter in the case of a laundry dryer.

A further object of the present invention is the provision of an improved access laundry appliance which provides more space in the non-rotating frontal area for added features to the appliance.

A further object of the present invention is the provision of an improved laundry appliance having a front wall which includes a space for permitting tumbling of the fabrics.

A further object of the present invention is the provision of an improved access laundry appliance which retains a capacity similar to that achieved with prior laundry appliances having poorer access.

A further object of the present invention is the provision of an improved laundry appliance having a front wall which deflects fabrics toward the rotating drum.

A further object of the present invention is the provision of an improved laundry appliance having greater ease of access to the rear of the rotating drum.

A further object of the present invention is the provision of an improved access laundry appliance which makes possible reaching into the fabric drum or container with the entire arm and shoulder with less bending as contrasted to the ability to reach in only to the upper arm in prior devices.

A further object of the present invention is to facilitate loading and unloading of fabrics into and out of the drum through the access opening.

A further object of the present invention is the provision of an improved access laundry appliance which is economical to manufacture, durable in use, and efficient in operation.

SUMMARY OF THE INVENTION

The foregoing objects are achieved by a laundry appliance having an outer cabinet defining an enclosed compartment.

A drum is rotatably mounted within the compartment for rotation about a substantially horizontal axis. The drum forms a fabric enclosure therein having an uncovered drum access opening providing communication to the fabric enclosure.

The cabinet includes an exterior front and upper cabinet surface formed by a cabinet front wall and a cabinet upper wall. The cabinet also has a cabinet access opening therein providing direct communication through the cabinet and the drum access opening into the fabric enclosure within the drum. The cabinet access opening is formed partially in the cabinet front wall and partially in the cabinet upper wall and includes a perimeter extending therearound. The perimeter extends between first and second vertical planes which are spaced apart from one another a predetermined distance. A cabinet door is hinged to the cabinet for hinged movement from an open position providing unhindered access into the fabric enclosure to a closed position in covering relation over the cabinet access opening.

DETAILED DESCRIPTION OF THE PREFERRED EMBODIMENT

Figure 1:
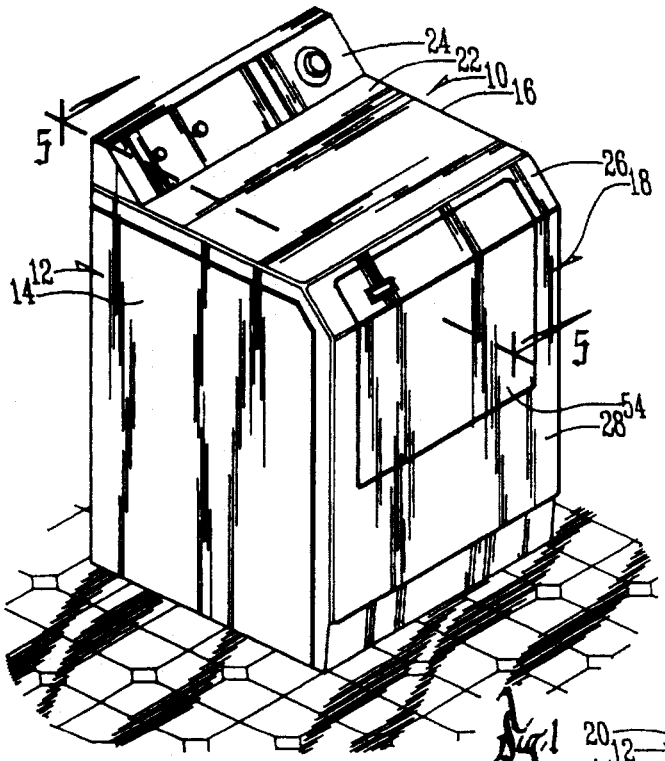
FIG. 1 is a pictorial view of the laundry appliance of the present invention.
Figure 3:
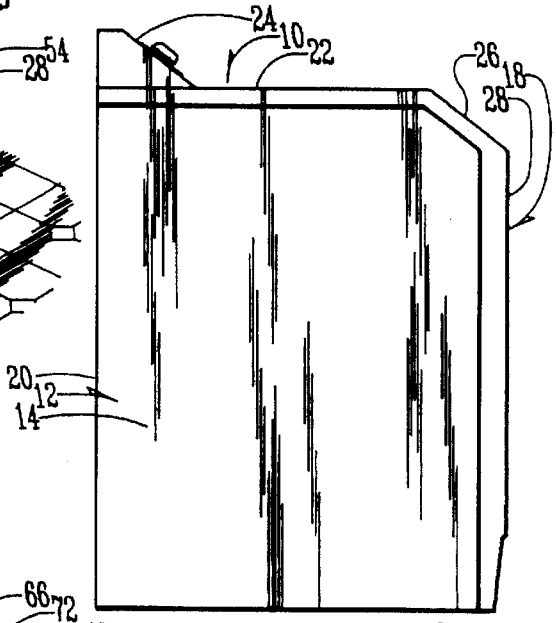
FIG. 3 is a side elevational view of the appliance shown in FIG. 1.
Figure 2:
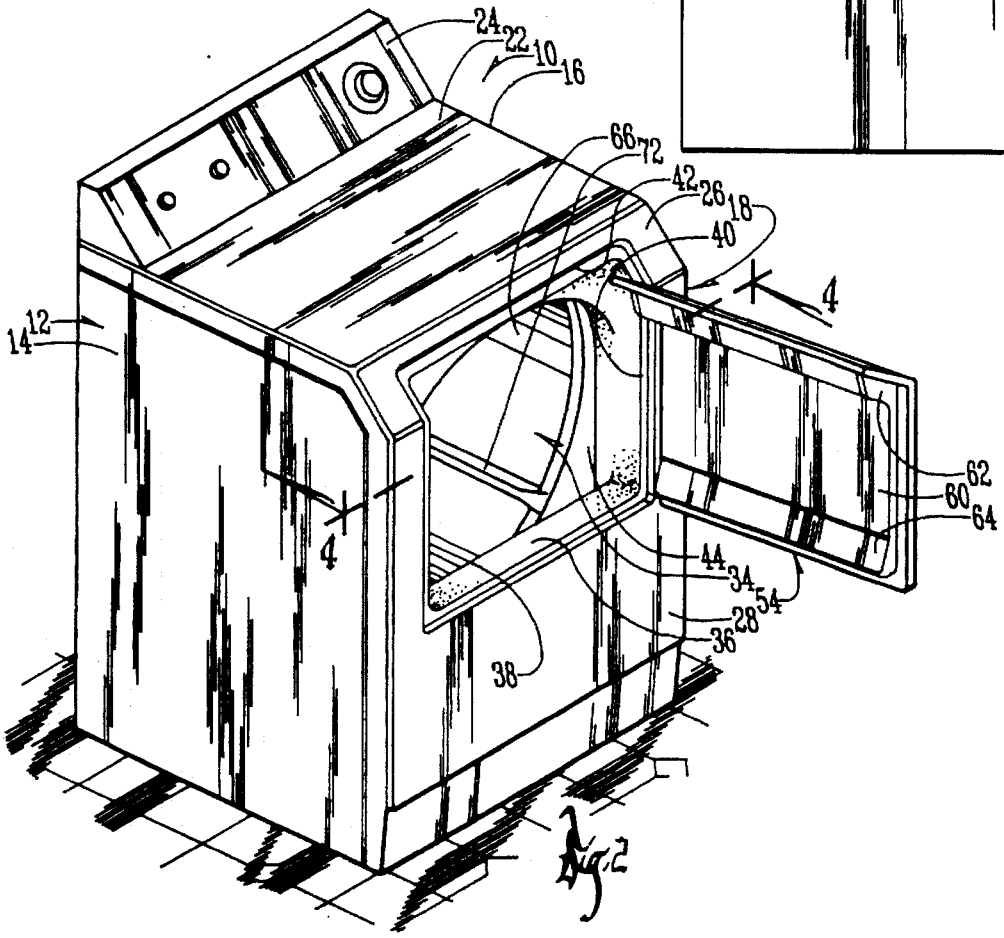
FIG. 2 is an enlarged pictorial view similar to FIG. 1, but showing the front door of the appliance open.
Figure 6:
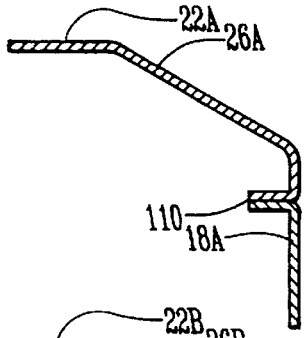
FIG. 6 is a sectional view taken generally along line 6—6 of FIG. 4, but showing a modified wall construction.
Figure 6A:
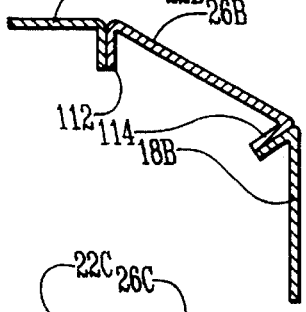
FIG. 6A is a view similar to FIG. 6, but showing another modified form of the wall construction.
Figure 6B:
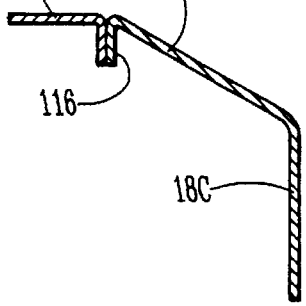
FIG. 6B is another view similar to FIG. 6, but showing yet another modified form of wall construction.

Referring to the drawings the numeral 10 generally designates a laundry appliance. Appliance 10 includes an outer cabinet 12 having side walls 14, 16, a front wall 18, a rear wall 20, and a top wall 22. At the rear of the top wall 22 is an upwardly projecting control panel 24. At the front edge of top wall 22 is a canted or inclined surface 26. In the embodiment shown in FIGS. 1 and 2, the cabinet front wall 18 and topwall 22 are shown to be of unitary construction. However, it is possible to vary the construction of the walls without detracting from the invention. For example, in FIGS. 6, 6A and 6B different wall constructions are shown. In FIG. 6 the top wall 22A is integrally formed with the canted or inclined surface 26A and a seam 110 is provided between the canted or inclined surface 26A and the front wall 18A. In FIG. 6A two seams 112, 114 are shown between the three wall portions 22B, 26B, and 18B. In FIG. 6B, a single seam 116 is provided between the front edge of top wall 22C and the upper edge of canted surface 26C. Canted or inclined surface 26C is shown integrally formed with the front wall 18C.

Figure 4:
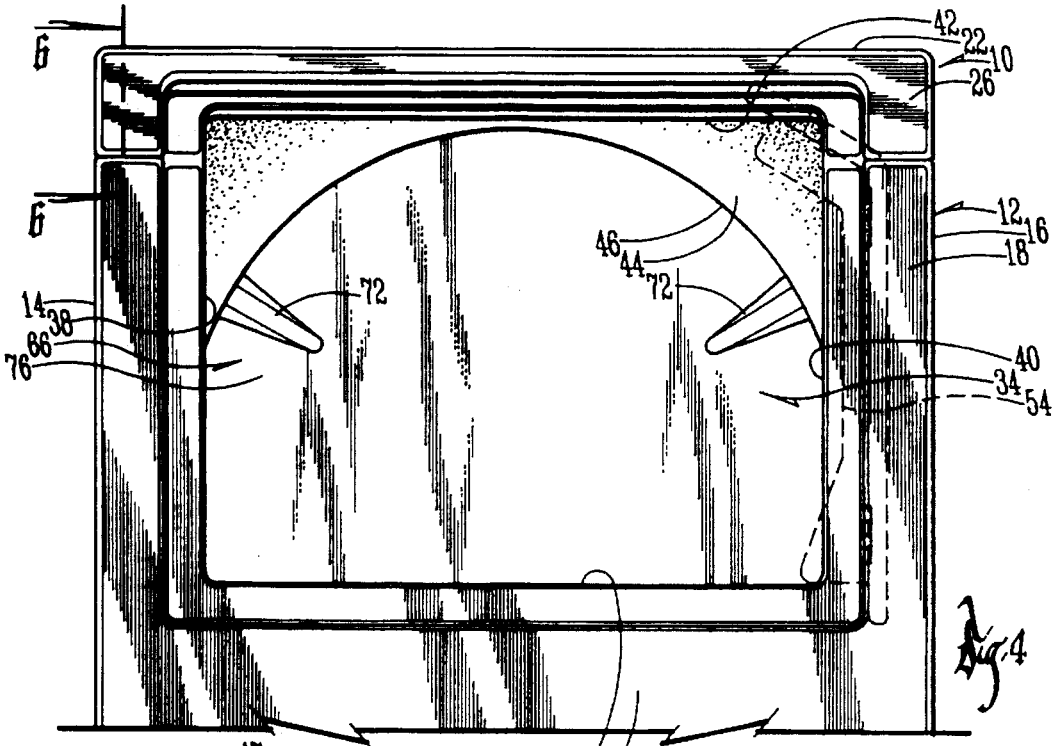
FIG. 4 is a front elevational view of the appliance taken generally along line 4—4 of FIG. 2.
Figure 5:
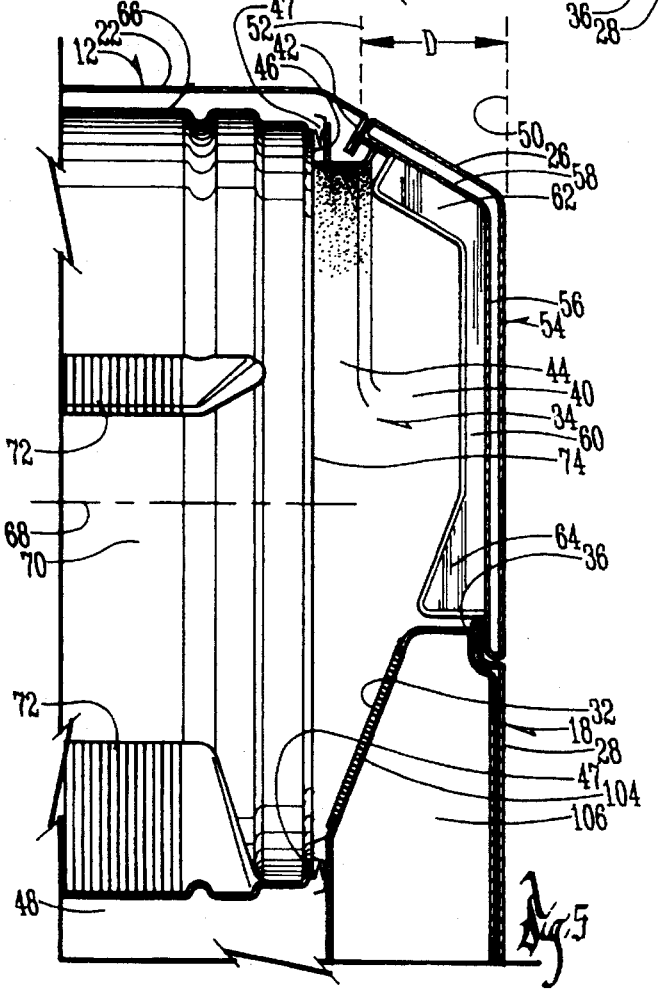
FIG. 5 is a partial sectional view taken generally along line 5—5 of FIG. 1.

Referring to FIGS. 4 and 5, there is shown front wall 18 comprised of a vertical front panel 28. A cabinet opening 34 includes a lower generally horizontal edge 36, generally vertical side edges 38, 40 (FIG. 2) and a substantially horizontal upper edge 42. The upper edge of an inclined inner surface 32 commences at the lower edge 36 of the cabinet opening 34 and progresses downwardly and inwardly therefrom. The front wall 18 is also provided with a skirt 44 which is somewhat cylindrical in shape and which extends horizontally inwardly where it transitions to support structure 46 for drum seal or gasket 47.

The cabinet 12 forms a cabinet compartment 48. Within the cabinet compartment 48 is an inner drum 66 which is rotationaly mounted about a substantially horizontal axis 68. Drum 66 includes a generally cylindrical wall 70 having paddles or blades 72 mounted thereon and extending radially inwardly therefrom. At the front of drum 66 is a drum access opening 74, and at the inner axial end of the drum 66 is a generally closed rear wall 76 (FIG. 4). The cabinet opening 34 provides access into the inner drum 66. Although this invention is not limited to a type of laundry appliance, the particular appliance shown in the drawings is a dryer, and therefore the inclined inner surface 32 is provided with an air outlet opening 104 which is connected to an outlet duct 106 and exhaust duct (not shown) so as to permit air to be drawn into the cabinet compartment 48, through a heating apparatus (not shown) and into and through the inner drum 66 for drying fabrics. The location of the air outlet opening 104 may be varied without detracting from the invention. Although not shown, a blower and an exhaust duct are located downstream of the outlet duct 106.

Cabinet opening 34 extends between two vertical planes 50, 52. The upper edge 42 is adjacent vertical plane 52 and the lower edge 36 of the opening 34 is adjacent the forward most vertical plane 50. This permits the operator to have a view from above the appliance 10 downwardly through the upper most portion of cabinet opening 34 into the inner drum 66. It also permits the operator to have direct physical access to the interior of the inner drum 66 to the extent that the operator can place his or her arm and shoulder into the inner drum 66.

A door 54 is shown hinged to the cabinet 12 on the right side of opening 34 but could be hinged to swing to the left or downward. The door 54 includes a vertical double panel 56 having a canted or inclined double panel 58 at the top thereof, sized and shaped to fit the inside perimeter of cabinet opening 34. On the interior surface of door 54 is an interior panel 60 which, in this embodiment, has an upper angled surface 62 and a lower angled surface 64. These angled surfaces 62, 64 cause fabrics or clothing to be deflected inwardly into the inner drum 66 when they strike the angled surfaces 62, 64.

In operation, the improved access opening 34 in the cabinet permits the operator to gain access to the interior of the drum 66 for viewing and for physical access to insert and remove fabrics and clothing. The fact that the cabinet opening 34 is accessible frontally as well as from the top permits viewing from above and permits the operator to place his or her arm and shoulder into the drum 66 for removing and inserting fabrics and clothes with less bending. Also more light is permitted to enter the drum, thereby making visual access easier and better. The air outlet opening 104 can be placed in the inclined surface 32. The thickness of the front wall provides more flexibility in arranging the air outlet opening 104. The thickness of the non-rotating frontal area which extends from the front panel 28 to the front of the inner drum 66 provides a space for clothes to tumble out of the drum access opening 74 against the surfaces 60, 62, 64 of the door 54 and also against the canted or inclined surface 32. The angular disposition of surfaces 62, 64, and 32 causes the clothes or fabrics to be deflected back into the drum 66 for recirculation and tumbling by the blades 72. Also the lower inclined surface 32 causes clothes or fabrics to be kicked away from the air outlet opening 104 so as to prevent blocking of that opening.

Another advantage of the present construction is that there is a shorter effective reach to the rear wall 76 of the drum and also to the control panel 24 at the rear of the cabinet. The shorter effective reach is accomplished by virtue of the fact that the upper edge 42 of the cabinet opening 34 is spaced inwardly from the front edge or surface 28 of the front wall.

Figure 7:
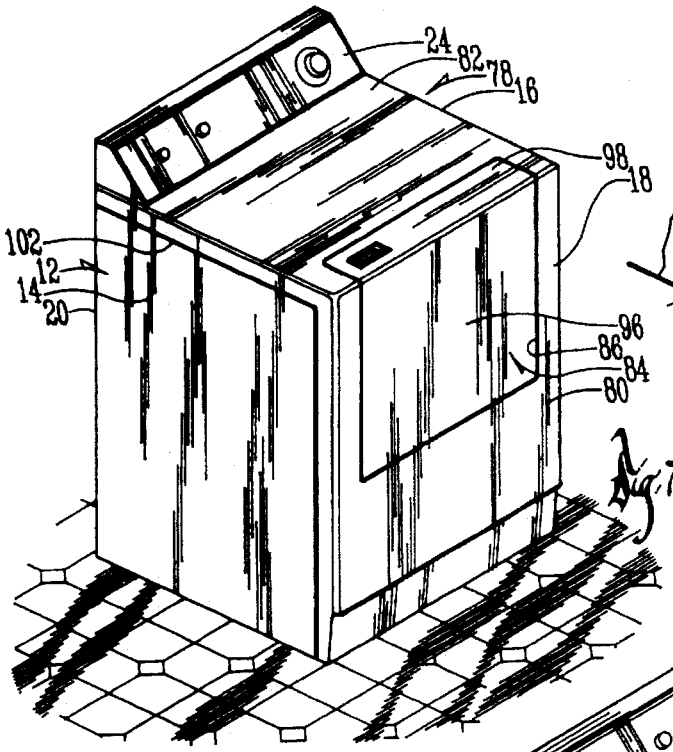
FIG. 7 is a pictorial view of a modified form of the present invention.
Figure 8:
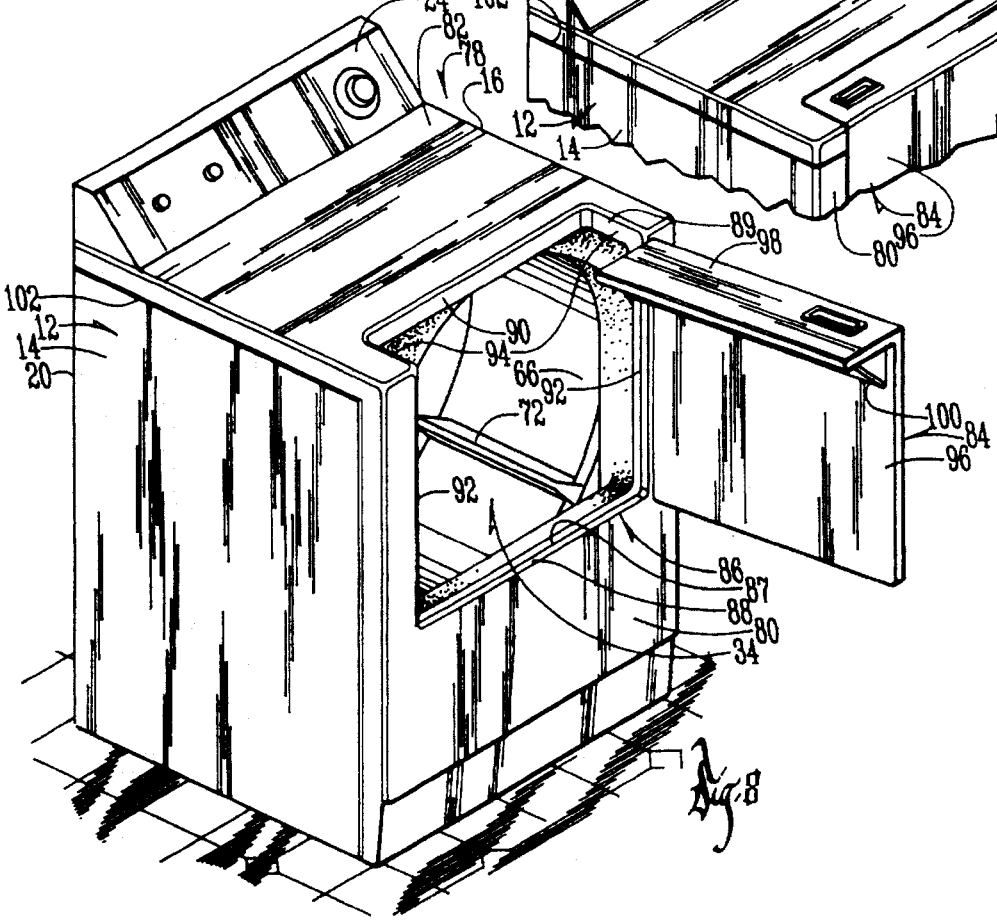
FIG. 8 is a pictorial view similar to FIG. 7, but showing the front door in an open position.

Referring to FIGS. 7–8, a modified form of the invention is shown and is designated by the numeral 78. Corresponding parts which remain unchanged from the appliance 10 shown in FIGS. 1–6 retain the same numerals. The primary change in the construction shown in FIG. 7 is the elimination of a canted or inclined surface 26 and instead the use of a right angle joint between the top wall 82 and the front wall 80. The door opening 86 includes a generally U-shaped vertical lower portion 87 and a generally U-shaped horizontal upper portion 89. Door opening 86 includes a bottom margin 88 and a top margin 90 which lie in two spaced apart generally vertical planes similar to the planes 50, 52 shown in FIG. 5. The perimeter of the door opening 86 also includes generally vertical side margins 92 and generally horizontal side margins 94. The door 84 includes a vertical lower portion 96 and a horizontal upper portion 98 which are sized and shaped to fit within and close off the access opening 86. An angled gusset wall 100 fits between the vertical portion 96 and the horizontal portion 98 of door 84.

Figure 10:
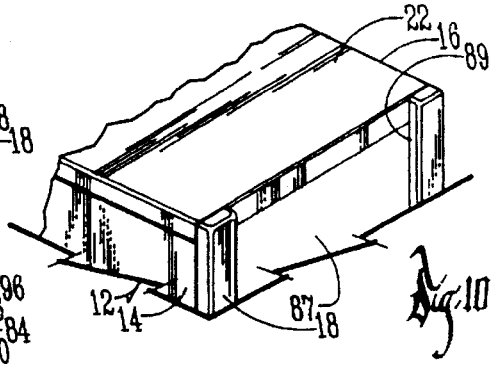
FIG. 10 is a partial pictorial view showing yet another modified form of wall construction.
Figure 9:
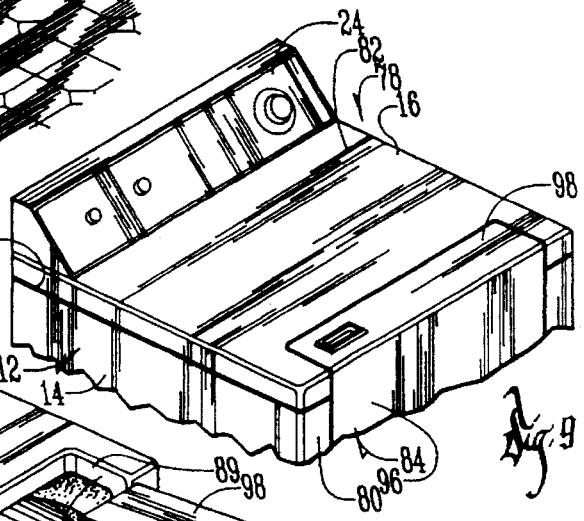
FIG. 9 is a detailed pictorial view of the top of the appliance showing a modified form of wall construction.

In the design shown in FIGS. 7 and 8, the front and top of the cabinet is shown to be made of unitary construction, but FIG. 9 illustrates that a seam 102 may be provided between the top wall 82 and the upper edges of front wall 80, and side walls 14, 16. In addition, the modification of FIG. 10 (shown without a door) illustrates a construction wherein the top wall 22 does not extend forward of the side walls 14 and 16 and the front wall 18 forms both U-shaped portions 87 and 89.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A laundry appliance comprising:

a cabinet defining an enclosed compartment;

a cylindrical drum rotatably mounted within said compartment, said drum forming a fabric enclosure for containing laundry therein, and having an uncovered drum access opening providing communication into said fabric enclosure, the drum including opposite axial ends, said drum access opening being in one of said opposite axial ends;

said cabinet having exterior front and top cabinet surfaces formed by cabinet front and top walls;

said cabinet having a cabinet access opening therein adjacent said drum access opening and providing direct communication through said cabinet and said drum access opening into said fabric enclosure;

said cabinet access opening being formed at least partially in said cabinet front wall and at least partially in said cabinet top wall and having a perimeter extending therearound, said perimeter extending between first and second substantially vertical planes which are spaced apart from one another to provide combined top and front access into said fabric enclosure;

transition structure between said first and second planes for transitioning said cabinet access opening into said drum access opening to facilitate said direct communication into said fabric enclosure; and a cabinet door operable for movement from an open position providing unhindered combined top and front access into said fabric enclosure through said transition structure to a closed position in covering relation over said cabinet access opening.

2. A laundry appliance according to claim 1 wherein said drum access opening includes a drum access opening perimeter lying approximately in a third substantially vertical plane.

3. A laundry appliance according to claim 2 wherein said third substantially vertical plane is adjacent or touching one of said first and second vertical planes and is located outside the space between said first and second vertical planes.

4. A laundry appliance according to claim 1 wherein said transition structure includes an inclined panel having an upper edge adjacent said perimeter of said cabinet access opening and having a lower end adjacent said drum access opening.

5. A laundry appliance according to claim 1 wherein said first vertical plane is in front of said second vertical plane, said perimeter of said cabinet access opening having a lower portion adjacent said first vertical plane and an upper portion adjacent said second vertical plane.

6. A laundry appliance comprising:

a cabinet defining an enclosed compartment;

a cylindrical drum rotatably mounted within said compartment, said drum forming a fabric enclosure for holding laundry therein and having an uncovered drum access opening providing communication into said fabric enclosure;

said cabinet having exterior front and top cabinet surfaces formed by cabinet front and top walls;

said cabinet having a cabinet access opening formed partially in said front wall and partially in said top wall and adjacent the drum access opening providing direct communication through said cabinet access opening and said drum access opening into said fabric enclosure;

transition structure for transitioning said cabinet access opening into said drum access opening with respect to said front and top walls to facilitate direct communication into said fabric enclosure;

said transition structure including an inclined inner panel below said cabinet access opening, said inclined panel having an upper edge adjacent said cabinet access opening and a lower end adjacent said drum access opening; and a cabinet door operable for movement from an open position providing unhindered access from both top and front into said fabric enclosure to a closed position in covering relation over said cabinet access opening.

7. A laundry appliance comprising:

a cabinet having a forward wall, a rear wall, side walls, and a top wall defining an enclosed cabinet compartment;

a generally cylindrically shaped drum rotatably mounted in said cabinet compartment and having a closed axial end and a generally cylindrical drum wall defining a drum compartment therein for holding laundry, said drum having an uncovered drum access opening providing communication into said drum compartment through said drum access opening;

said cabinet having a cabinet access opening adjacent said drum access opening and having a forwardly facing portion and an upwardly facing portion for providing direct communication through said cabinet access opening and said drum access opening into said drum compartment;

a cabinet door operable for movement from an open position providing unhindered access into said drum compartment to a closed position in covering relation over said cabinet access opening; and said drum access opening having a perimeter edge which is substantially parallel to said forward wall of said cabinet.

8. A laundry appliance comprising:

a cabinet having a forward wall, a rear wall, side walls, and a top wall defining an enclosed cabinet compartment;

a generally cylindrically shaped drum rotatably mounted in said cabinet compartment and having a closed axial end and a generally cylindrical drumwall defining a drum compartment therein for holding laundry, said drum having an uncovered drum access opening providing communication into said drum compartment through said drum access opening;

said cabinet having a cabinet access opening adjacent said drum access opening and having a forwardly facing portion and an upwardly facing portion for providing direct communication through said cabinet access opening and said dram access opening into said drum compartment;

a cabinet door operable for movement from an open position providing unhindered access into said drum compartment to a closed position in covering relation over said cabinet access opening; and said front wall of said cabinet including a skirt extending between said cabinet access opening and said drum access opening.

* * * * *